US006995330B2

(12) United States Patent
Gimeno

(10) Patent No.: US 6,995,330 B2
(45) Date of Patent: Feb. 7, 2006

(54) EARTHING SWITCH

(75) Inventor: Carmelo Gimeno, Aarau (CH)

(73) Assignee: Areva T & D SA, Levallois-Perret Cedex (FR)

( * ) Notice: Subject to any disclaimer, the term of this patent is extended or adjusted under 35 U.S.C. 154(b) by 0 days.

(21) Appl. No.: 10/919,779

(22) Filed: Aug. 16, 2004

(65) Prior Publication Data

US 2005/0035087 A1 Feb. 17, 2005

(30) Foreign Application Priority Data

Aug. 14, 2003 (FR) ..... 03 09961

(51) Int. Cl.
*H01H 33/70* (2006.01)

(52) U.S. Cl. ..... 218/79; 218/43

(58) Field of Classification Search ..... 218/7, 218/14, 154, 43–88, 120, 140; 361/604–621
See application file for complete search history.

(56) References Cited

U.S. PATENT DOCUMENTS 4,429,199 A * 1/1984 Pircher et al. ..... 218/44
6,559,403 B2 * 5/2003 Gutalj ..... 218/79

FOREIGN PATENT DOCUMENTS

DE 196 12 273 2/1997
GB 2 193 843 2/1988
WO WO 96/17420 6/1996

* cited by examiner

*Primary Examiner*—Lincoln Donovan
*Assistant Examiner*—M. Fishman
(74) *Attorney, Agent, or Firm*—Thelen Reid & Priest LLP

(57) ABSTRACT

A high for medium voltage gas insulated earthing switch comprises at least one conducting bar in an enclosure, with a corresponding earthing contact and a phase contact fixed to the said bar that will be electrically connected to the earthing contact to earth the said bar. The earthing contact is installed fixed in the enclosure facing the phase contact, leaving a free space (E) between this phase contact and the earthing contact. A switching element is installed free to move in the enclosure between the phase contact and the earthing contact, and comprises firstly a switching contact that short circuits the space left free (E) to electrically connect the earthing contact and the phase contact when the earthing switch is closed, and secondly an at least partly electrically insulating support on which the switching contact is fixed such that the switching contact is electrically isolated from the phase contact and from the earthing contact when the earthing switch is in an open position.

18 Claims, 6 Drawing Sheets

EARTHING SWITCH

CROSS-REFERENCE TO RELATED APPLICATION

This application claims priority to French Application No. 03 09961, filed on Aug. 14, 2003, entitled: "Earthing Switch" by Carmelo Gimeno and was not published in English.

1. Field of the Invention

This invention relates to a high or medium voltage gas insulated earthing switch comprising at least one conducting bar in a hermetically sealed enclosure that will be filled with a dielectrically insulating gas, with a corresponding earthing contact, a phase contact fixed to the said bar that will be electrically connected to the earthing contact to earth the said bar.

2. Background of the Invention

The invention is particularly applicable to an earthing switch called a high speed earthing switch, this type having a very short switching time due to a spring control that avoids the formation of electrical arcs.

Document WO 96/17420 describes an existing three-phase earthing switch like that described above. In this known earthing switch, the three conducting bars are cranked radially in the enclosure such that their ends are arranged around the periphery of the path of a rotating conducting part connected to the earth. The disadvantage of this construction is that it is complicated and expensive to make. Furthermore, this construction is large due to the fact that the conducting bars have to be bent. Furthermore, with this construction, it is impossible to measure the electrical resistance of each conducting bar individually.

An earthing switch like that described in WO 96/17420 is described in patent SE 420 033. This earthing switch comprises an earthing contact that is moved towards each conducting bar along a longitudinal direction parallel to the axis of the bars. Another disadvantage of this arrangement is that it is large.

The purpose of the invention is to overcome the disadvantages mentioned above by proposing a more compact earthing switch that is mechanically simpler and that can be used to measure the electrical resistance on each conducting bar when the earthing switch is closed.

The invention achieves this purpose by using a high or medium voltage gas insulated earthing switch comprising at least one conducting bar in a hermetically sealed enclosure that will be filled with a dielectrically insulating gas, with a corresponding earthing contact, a phase contact fixed to the said bar that will be electrically connected to the earthing contact to earth the said bar, characterised in that the earthing contact is installed fixed in the enclosure facing the phase contact, leaving a free space between this phase contact and the earthing contact, and in that a switching element is installed free to move in the enclosure between the phase contact and the earthing contact, this switching element comprising firstly a switching contact that short circuits the space left free between the phase contact and the earthing contact to electrically connect the earthing contact and the phase contact when the earthing switch is closed, and secondly an at least partly electrically insulating support on which the switching contact is fixed such that the switching contact is electrically isolated from the phase contact and from the earthing contact when the earthing switch is in an open position.

BRIEF DESCRIPTION OF THE INVENTION

According to a first embodiment of a three-phase earthing switch according to the invention:

- the three parallel conducting bars are arranged in an equilateral delta configuration and the switching element is installed free to rotate about a rotation axis arranged at the centre of the triangle; this construction has the advantage that it uses a maximum amount of space left free between the conducting bars, which contributes to reducing the size of the earthing switch;
- the switching element may comprise three switching contacts installed according to a delta configuration on a rotating support made of an electrically insulating material, the support advantageously being arranged in star form with three arms;
- the switching element can be installed free to rotate on a cover closing the enclosure.

According to a second embodiment of a three-phase earthing switch according to the invention:

- the three parallel conducting bars are arranged in a row and the switching element is installed free to slide in the enclosure transverse to the conducting bars;
- the switching element comprises three contacts arranged in row configuration on a sliding support made of an insulating material;
- the sliding support is a bar made of an insulating material.

The earthing switch according to the invention may also have the following special features:

- the contacts of the switching element can be deformed elastically;
- the contacts of the switching element are in U shape and include elastically deformable contact pins;
- the contacts of the switching element are in the form of a closed curve and include elastically deformable contact elements,
- the contacts of the switching element are equipped with two switching rods, each of which will be inserted in a female tulip-shaped contact of one of the two contacts, and the switching rod corresponding to the earthing contact is longer than the other rod.

This arrangement of the contacts of the switching element helps to obtain better insertion of these contacts into the space left free between an earthing contact and a phase contact, while increasing the contact pressure which is useful for high current values.

BRIEF DESCRIPTION OF THE DRAWINGS

Several example embodiments of an earthing switch according to the invention are described below and are illustrated by the drawings.

In FIG. 9, the earthing switching is in the closed position.

DETAILED DESCRIPTION

Figure 1:
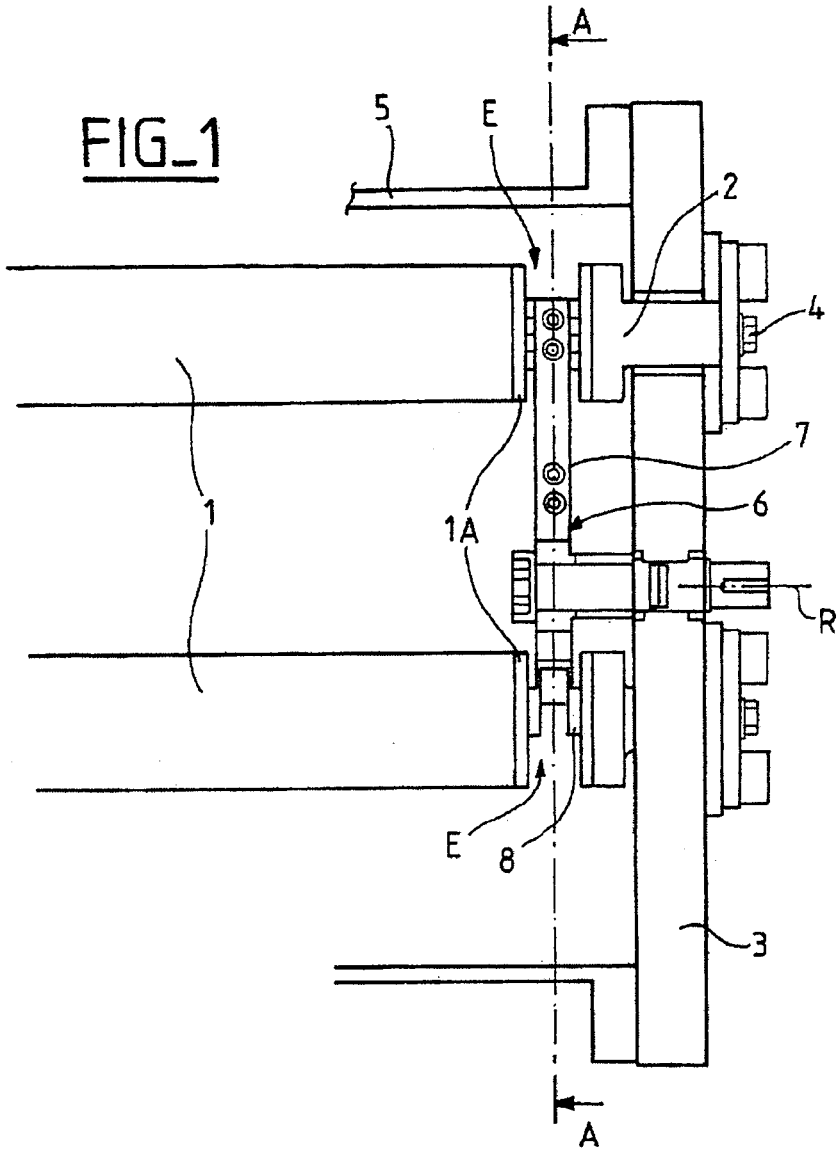
FIG. 1 is a side view showing a longitudinal section of a three-phase earthing switch according to the invention with a rotating switching element.

FIG. 1 shows a three-phase earthing switch according to the invention with a rotating switching element, as a non-limitative example. The earthing switch comprises three parallel conducting bars 1 in a sealed enclosure 5 to be filled with a dielectric gas such as SF6, and arranged in an equilateral triangle configuration, only two conducting bars 1 being shown in FIG. 1. An earthing contact 2 is shown in this case in the axial extension of each conducting bar 1 facing a phase contact electrically connected to the corresponding conducting bar. The earthing contact and the phase contact are separated from each other by a space left free E, this space E being sufficient to provide a dielectric isolation. It would be possible for the earthing contact and the phase contact to be slightly offset from the axis of the corresponding bar, without going outside the scope of the invention, if for example the phase contact is fitted on a small tab fixed to the bar and extending transverse to it. In this case, the earthing contact and the phase contact are still aligned with the axis of the corresponding conducting bar.

As can be seen in FIG. 1, the three earthing contacts 2 that are fixed in the enclosure are associated with the corresponding three phase contacts of the conducting bars 1. Each earthing contact is mounted passing through a typically metallic cover 3 fixed to the enclosure, and is isolated from the cover by means of an insulating tube T more clearly visible in FIG. 1A. The dimensions (particularly the thickness of the tube wall) are chosen to maintain the insulation between the earthing contact and the cover during a voltage pulse typically of the order of a few kilovolts affecting this earthing contact. On the outside of the cover 3, each earthing contact 2 forms an earthing connector 4 that will be connected to the earth and that will also be used for measuring the electrical resistance of the conducting bar associated with it when the earthing switch is closed.

The cover 3 that is usually made from the same material as the enclosure, typically aluminium, hermetically seals the enclosure 5 of the earthing switch, in this case a tubular shaped metallic enclosure. As can be seen in FIG. 1, the cover 3 is arranged at one end of the tubular enclosure 5, which facilitates maintenance operations of the earthing switch according to the invention.

In this type of earthing switch according to the invention, it is not absolutely essential that the earthing contacts 2 are electrically isolated from the cover 3. Since this cover is usually metallic and at the same earthing potential as the enclosure 5 of the earthing switch, it can be used to evacuate currents from the three phases to the earth when the earthing switch is closed. Obviously, with this configuration, it is no longer possible to measure the electrical resistance of a conducting bar, in the closed position of the earthing switch, by connecting a test instrument onto the earthing contact corresponding to this bar.

The earthing switch described in FIG. 1 also comprises a switching element 6 in the enclosure free to move in rotation in a plane transverse to the bars 1 and that is composed of a support 7 free to rotate about an axis R and three electrical switching contacts 8. The contacts 8 are preferably made from materials resistant to electric arcs, such as copper covered with tungsten. The support 7 is a three arm star shaped support that is at least partly electrically insulating, the contacts 8 being fixed to the arm ends of the support arms 7 such that they are electrically isolated from the earth and the phase contacts when the earthing switch is in an open position. The rotation shaft with axis R which passes through the cover 3 may be metallic.

In FIG. 1, the earthing switch is closed and the contacts 8 are inserted in the space left free E between an earthing contact 2 and a phase contact fixed to the corresponding end of a connecting bar 1. This end of the conducting bar is advantageously covered by is an appropriate metal in this case in order to form the phase contact 1A. The contacts 8 are arranged such that they are elastically deformable (in this case along the axial direction of the bars) to facilitate their insertion between the phase contacts 1A of the conducting bars and the earthing contacts 2.

Advantageously, these switching contacts 8 are U shaped with elastic contact pins at each end of an arm of the U, such that the current circulating in one arm is opposite to the current circulating in the other arm, tending to move each arm away from the other for high current values. This increases the contact pressure between the contact pins of one arm of the U and the fixed phase contact or the earthing contact on which these pins press, thus preventing erosion of the contact. The edges of the contact pins of one switching contact 8 are rounded for dielectric and mechanical reasons.

Figure 1A:
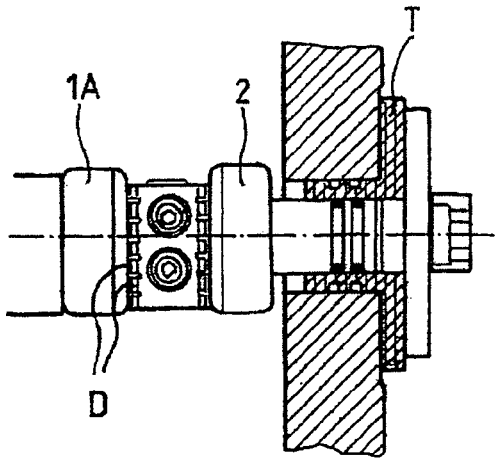
FIGS. 1A, 1B, 1C show an earthing contact fixed in the enclosure in more detail.
Figure 1B:
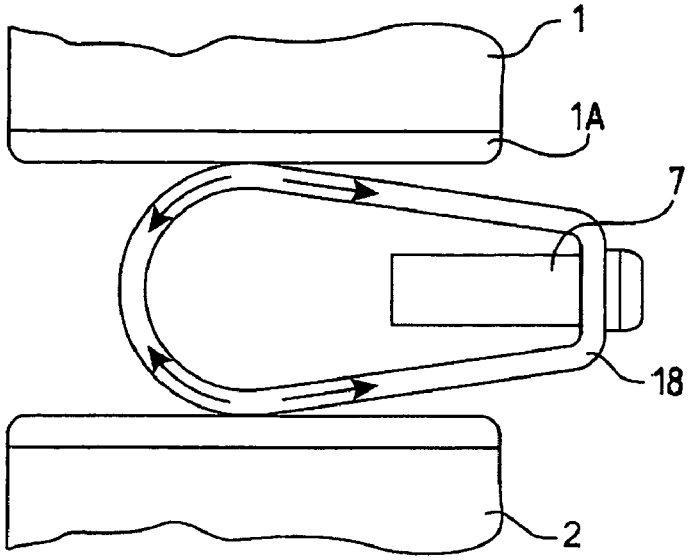
Figure 1C:
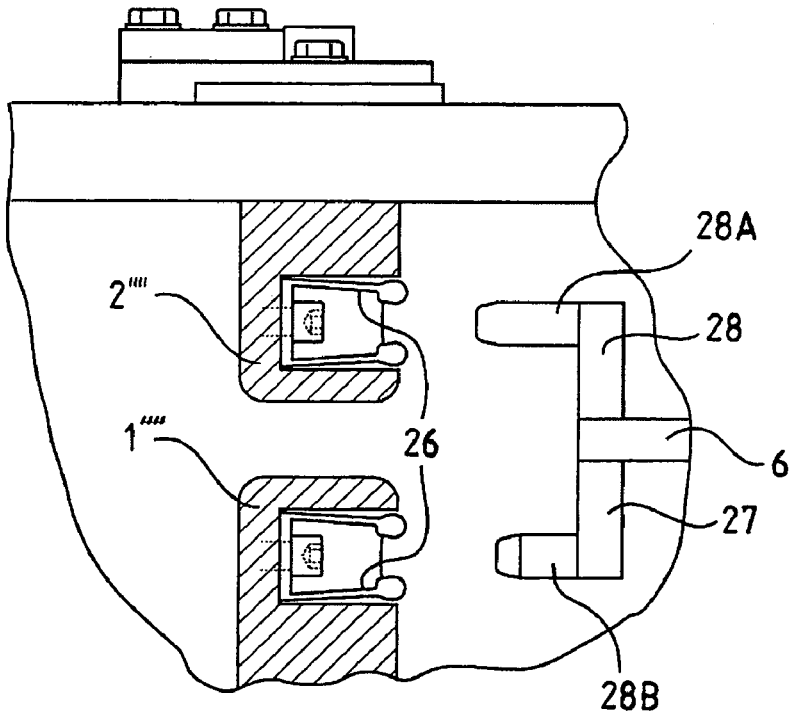

FIGS. 1B and 1C describe two variants of embodiments of the switching contacts 8. in FIG. 1B, each switching contact 18 is in the form of a closed curve, for example partially ovoid, fixed to support 7. Each switching contact 18 may be split by striations to improve its elastic nature. The basic material is a good electrical conductor, for example copper-chromium. The curved parts may be made of tungsten, while the contact points are placed in a tungsten free area in the contact position. The closed or ovoid shape may be asymmetric with respect to contact points, or it may be symmetric. With this type of switching contact 18, the current may take two different paths, symbolised by arrows, on each side of this closed shape, the reaction forces of the current to switching elements being reduced. With a O shaped form, the current may take symmetrically two same paths.

FIG. 1C shows a variant embodiment of the shape of the contact elements. These contact elements 28 have two rods 28A and 28B fixed onto a conducting support. When the earthing switch is closed, these rods 28A and 28B each penetrate into a female tulip-shaped contact 26, fixed in a cavity of the conducting bar 1"" and the earthing contact 2"", respectively. One of the two rods 28A is longer than the second rod 28B such that it comes into contact with its female contact 26 of the earthing contact 2"" before the second rod 28B comes into contact with its female contact 26 in the conducting bar 1"". Since these two rods 28A and 28B rotate about the rotation axis R of the switching element 6, their position relative to their corresponding female contacts 26 can vary slightly. Also, the female tulip shaped contacts 26 are elastic or are fixed so as to be able to make a small radial movement with respect to rods 28A and 28B.

Figure 2:
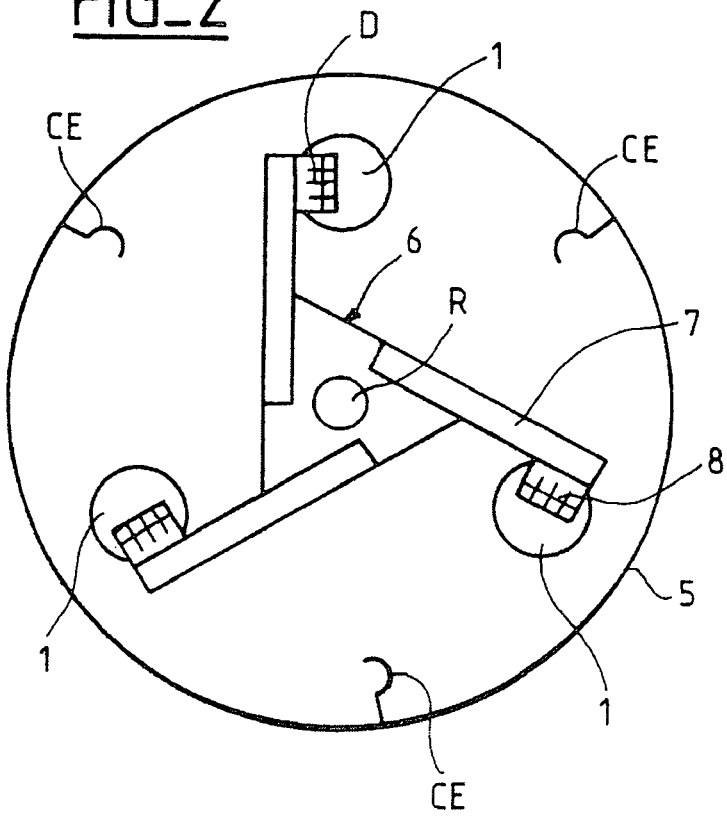
FIG. 2 is a very diagrammatic view along section A—A in FIG. 1 of the switching element when the earthing switch is closed.
Figure 3:
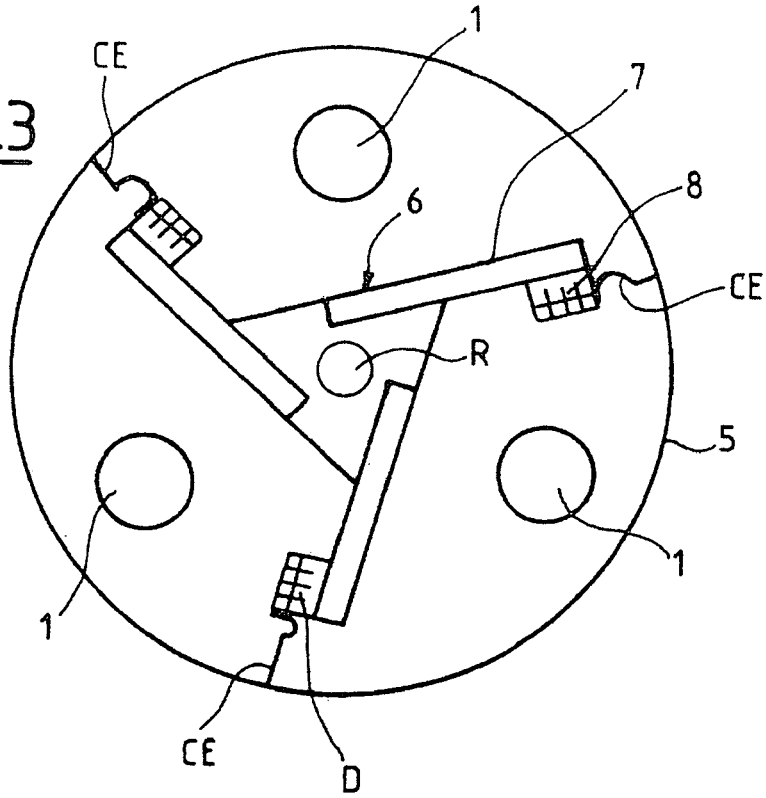
FIG. 3 is similar to FIG. 2, except that the earthing switch is in an open position.

The contact pins D, illustrated in FIGS. 2 and 3 but more easily visible in FIG. 1A, are covered by a material resistant to an electric arc such as tungsten, such that the tungsten does not touch the surface of the phase and earthing contacts, but is arranged in front of the contact pins to hold the electric arc first. The contact area of the contact pins on the fixed earthing and phase contacts is made with copper or brass, or preferably galvanised silver. Similarly, these phase and earthing contacts 1A and 2 respectively are covered with a material resistant to an electrical arc such as tungsten, for example by fixing (by welding or other) tungsten rings on the edges of the front face and are also galvanised with silver as is known for this type of contact.

FIG. 2 shows the switching element 6 when the earthing switch is closed, and FIG. 3 shows the switching element 6 when the earthing switch is opened. FIGS. 2 and 3 show the three-arm star shape of the support 7 and the contacts 8 arranged in a delta configuration at the ends of the support arms 7.

To connect the conducting bars 1 to the earth, the mobile switching element 6 makes a rotation about the rotation axis R and the switching contacts 8 supported by this element 6 fit transverse to the axis of the conducting bars 1 into the space left free between the phase contacts of the conducting bars 1 and the earthing contacts 2. The switching element is rotated by a control (not shown) that is coupled to the rotation axis R (control shaft) from outside the enclosure. The switching contacts 8 then make the electrical connection between the phase contacts of the conducting bars 1 and the earthing contacts 2. FIGS. 2 and 3 show contacts 8 with several elastically deformable contact pins.

FIGS. 2 and 3 also show that the rotation axis R of the switching element 6 is located at the centre of the delta defined by the equilateral delta configuration of the conducting rods 1.

FIG. 3 shows the earthing switch in the open position. The switching contacts 8 are arranged in the space between two adjacent conducting bars. Advantageously, the elastic contacts CE may be fixed to the cover and in electrical contact with the cover, so as to electrically connect each switching contact to the cover in the open position of the earthing switch. A single leaf spring fixed to the cover may be sufficient for a reliable electrical connection between a switching contact and the cover. The result is that this prevents the switching contacts 8 from being at a floating potential in the open position, which could cause partial discharges.

Figure 4:
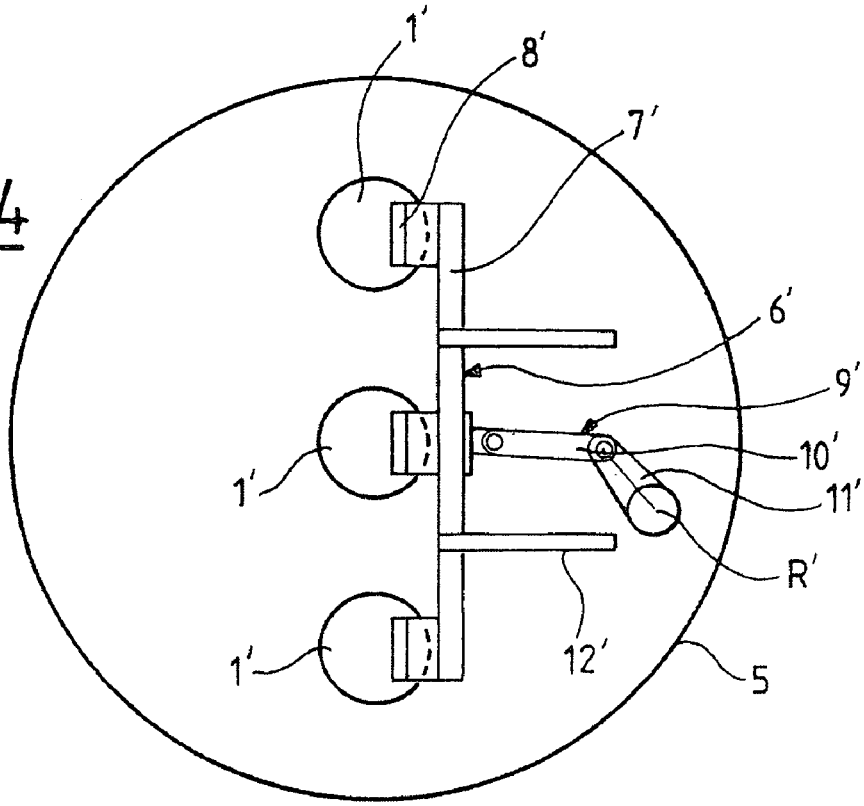
FIG. 4 is a very diagrammatic view similar to FIG. 2 of an earthing switch in a closed position with a switching element with a translation movement.
Figure 5:
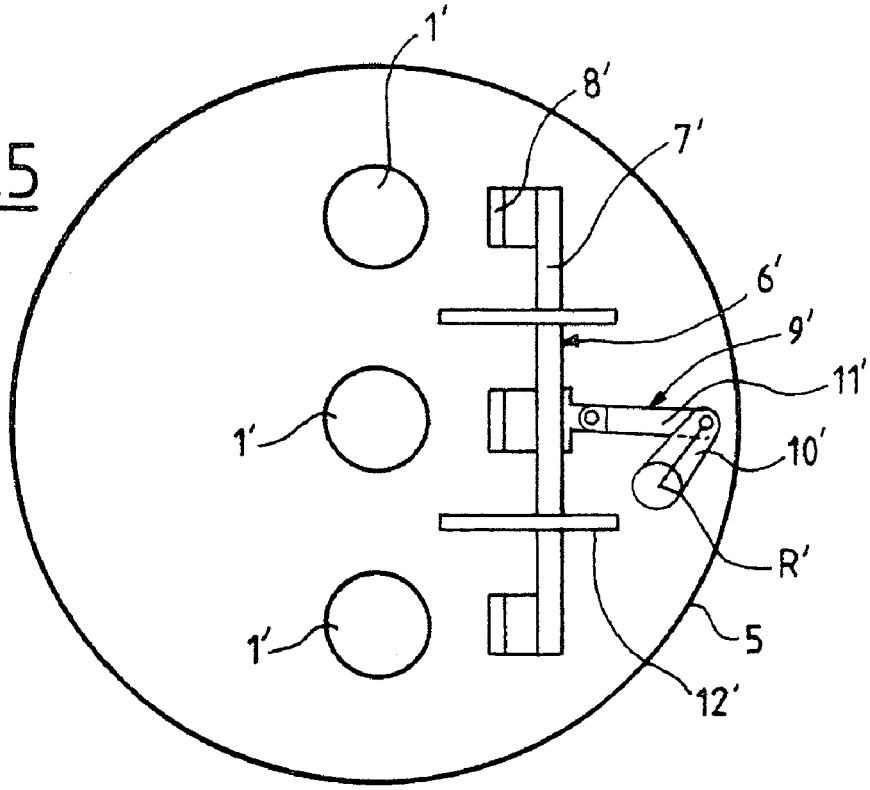
FIG. 5 is similar to FIG. 4 but shows the earthing switch in an open position.

FIGS. 4 and 5 show a three-phase earthing switch, which is different from the earthing switch shown in FIGS. 2 and 3 in that it comprises parallel conducting bars 1' arranged in a row arrangement, in other words in a superposed configuration. As can be seen in these figures, the switching element 6' is mounted free to slide in the enclosure 5 transverse to the conducting bars 1', the switching contacts 8' supported by the switching element 6' fitting into the space left free between the phase contact of each conducting bar 1' and each earthing contact (not shown in these Figures). FIG. 4 shows the switching element 6' when the earthing switch is closed and FIG. 5 shows the switching element 6' when the earthing switch is open.

The switching element 6' is composed of a sliding support 7', in this case a bar made of an insulating material, on which three switching contacts 8' similar to those shown in FIGS. 1 to 3 are fixed in a row configuration.

FIGS. 4 and 5 show a mechanism 9' transforming a rotating movement around a rotation axis R' of a lever 11' into a translation movement of a connecting rod 10' with an articulated connection to the support 7' that is guided in translation in a plane perpendicular to the bars 1' by guides 12'. In this example embodiment, the rotation axis R' and the earthing contacts (not shown) are mounted in a cover that closes the end of the enclosure 5.

To earth the conducting bars 1', the mobile switching element 6' moves in translation and the switching contacts 8' are inserted transverse to the axis of the conducting bars 1' in the space left free between the phase contacts of the conducting bars 1' and the earthing contacts. The contacts 8' can make the electrical connection between the phase contacts of the conducting bars 1' and the earthing contacts 2'.

Figure 7:
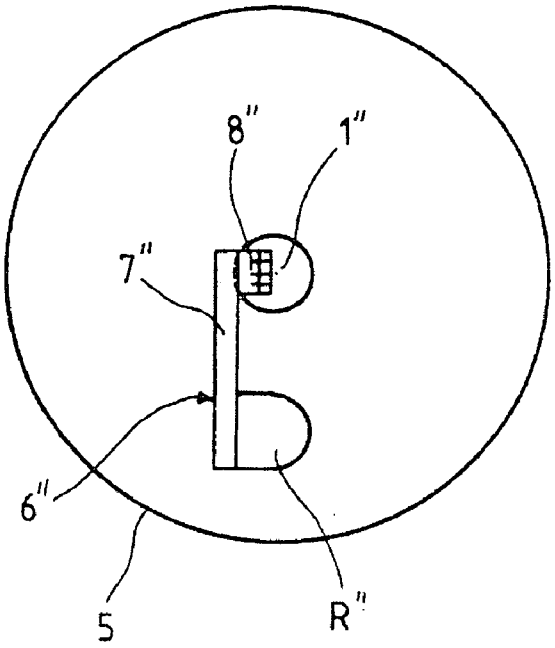
FIG. 7 shows a very diagrammatic sectional view along A'—A' in FIG. 6 of the switching element when the earthing switch is closed.
Figure 6:
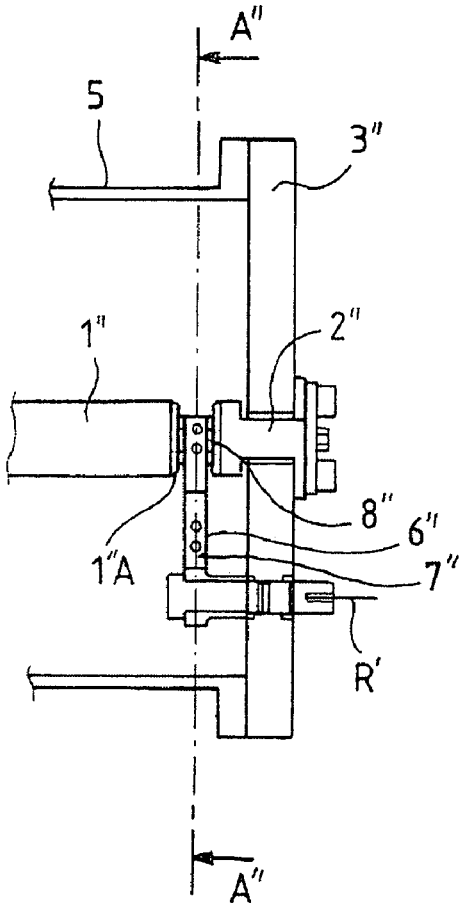
FIG. 6 shows a side view of a longitudinal section through a single phase earthing switch according to the invention with a rotating switch element.
Figure 8:
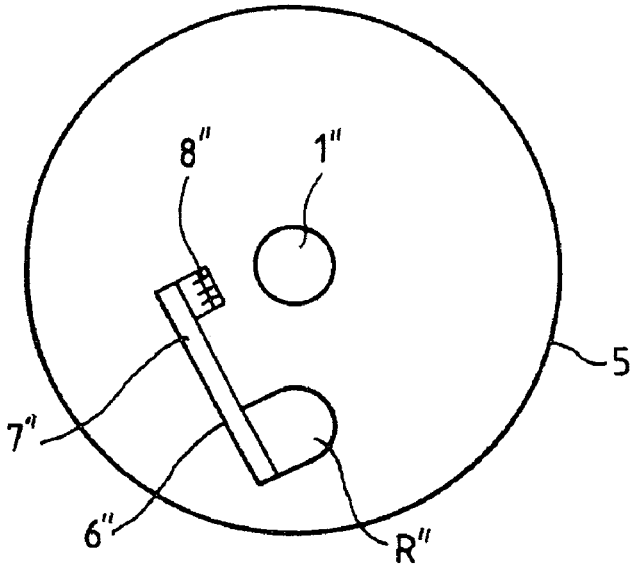
FIG. 8 is similar to FIG. 7 but shows the earthing switch in an open position.

FIGS. 6 to 8 show a single phase earthing switch with a rotating mobile switching element 6".

The operating principle of the earthing switch is the same as that described with relation to FIGS. 1 to 3. As can be seen in FIGS. 6 to 8, the earthing switch comprises a single conducting bar 1" in the enclosure 5 (with a phase contact 1A") coaxial with the tubular enclosure 5 and a single earthing contact 2" arranged along the axial extension of the bar 1" and installed passing through the cover 3" closing the enclosure 5". The switching element 6" supports a single switching contact 8" as was already described above and is fitted on a support 7" made of an insulating material, in this case an arm made of an insulating material mounted on a rotation axis R" passing through the cover 3".

FIGS. 7 to 8 show the central position of the single conducting bar 1" and the off-centre position of the rotation axis R".

As can be easily understood, the control of the earthing switch according to the invention drives the rotation axis R, R', R" and is preferably arranged on the outside of the cover closing the enclosure and therefore on the longitudinal extension of the enclosure which further contributes to obtaining good compactness of the earthing switch according to the invention.

Figure 9:
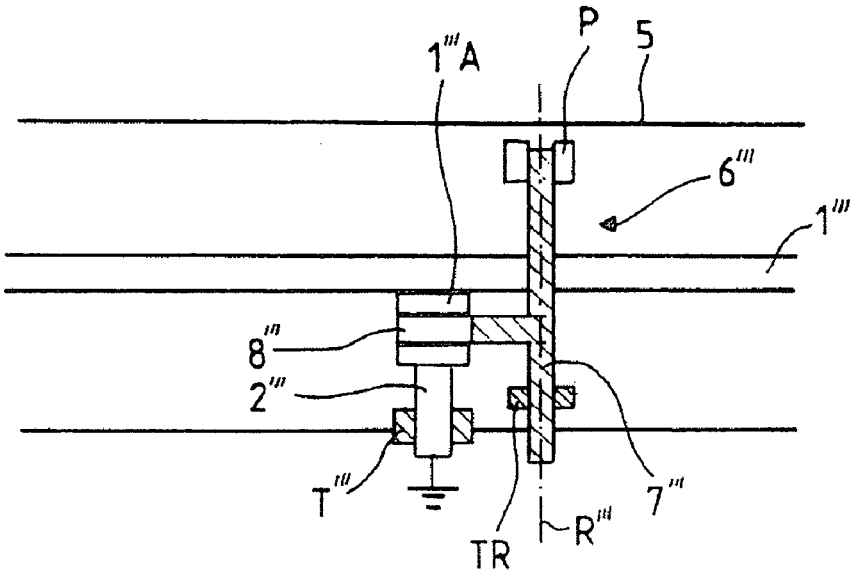
FIG. 9 shows another arrangement of an earthing switch according to the invention in which the earthing contacts and the phase contacts are aligned transverse to the conducting bar.
Figure 10:
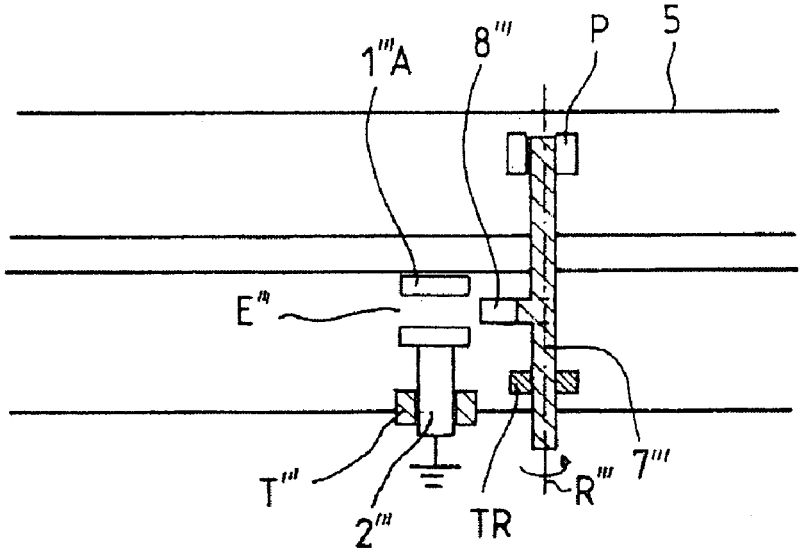
FIG. 10 shows the earthing switch illustrated in FIG. 9 but in an open position.
Figure 11:
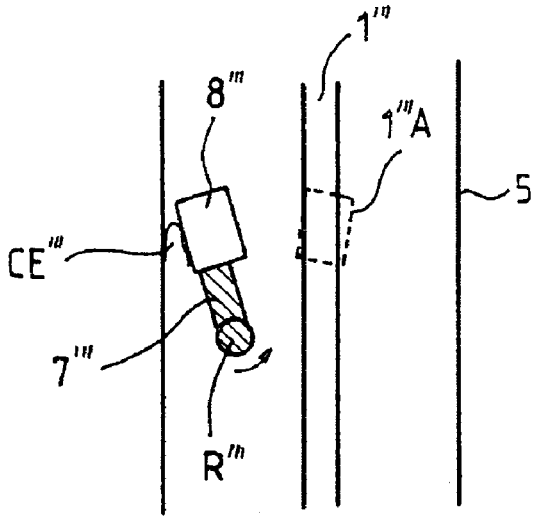
FIG. 11 shows a top view of the earthing switch shown in FIG. 10.

FIGS. 9 to 11 show another arrangement of a single phase earthing switch according to the invention arranged to be installed on a segment of the conducting bar. This type of earthing switch may be in the form of a module with a sufficiently short cylindrical enclosure to be able to access the elements of this earthing switch during assembly or disassembly. This enclosure surrounds a conducting bar that may be held in position conventionally by insulating supports, for example such as two insulating cones fixed to the two ends of the enclosure. This type of earthing switch module will then be inserted in a sealed manner between two shielded units (gas insulated) or between a shielded line segment and a shielded instrument.

According to this arrangement of the earthing switch, the earthing contact 2'" and the phase contact 1'"A are not aligned with the axis of the conducting bar 1'". The phase contact 1'"A is fixed on the side of the conducting bar while the earthing contact 2"" is fixed in the enclosure 5 facing the phase contact, these two contacts being aligned transverse to the conducting bar, leaving a free space E'" between them. The switching element 6'" that is free to rotate comprises a switching contact 8'" that is fixed to a support 7'" rotating around a rotation axis. R'" passing through the cylindrical wall of the enclosure. The rotating support 7'" is at least partly composed of an insulating material.

FIG. 9 shows the earthing switch closed and the switching contact inserted between the phase and earthing contacts in the free space E'". FIG. 10 shows the earthing switch in FIG.

9 in the open position while FIG. 11 shows the earthing switch in the open position as seen from above. As can be seen in FIG. 11, the rotation axis R''' of the rotating support 7''' is naturally offset from the axis of the conducting bar 1''' and the rotating support 7''' is held in position by a bearing P fixed inside the enclosure and by a sealed crossing TR through which the rotating support 7''' passes out of the enclosure to be coupled to a control device. There is no need for the support part 7''' that passes through the enclosure at the sealed crossing TR to be made of an insulating material, and this part may advantageously be separable from the remainder of the support 7''' to facilitate assembly of most of the support through the inside of the enclosure.

The earthing contact 2''' is electrically isolated from the enclosure by an insulating tube T''' similar to the tube T shown in FIG. 1A. FIG. 11 shows an elastic contact CE''' on which the switching contact 8''' comes into electrical contact when the earthing switch is completely opened. As previously mentioned for the elastic contacts CE that can be seen in FIGS. 2 and 3, this avoids the switching contact 8''' from being at a floating potential in the fully open position of the earthing switch.

Obviously, this arrangement of the earthing switch may easily be extended to a three-phase earthing switch, and in particular more easily to an earthing switch for three conducting bars superposed in the same enclosure. In the same way as for the previous arrangement for a single phase earthing switch, a rotating support formed partly by an insulating rod that is offset from the plane containing the three axes of the conducting bars can be used. Each of the three switching contacts is then supported by an insulating arm fixed to the rod and is thus mobile in a plane perpendicular to the plane of the bars. A modular arrangement of such a three-phase earthing switch can be provided with the advantages of a single control to earth the three phases while remaining relatively compact.

Obviously, this invention is in no way limited to the embodiments that have just been described and shown and that are given only as examples; in particular, it will be possible to modify some arrangements without going outside the scope of the invention, or to replace some means by equivalent means or to replace some elements by others that could perform the same technical function or an equivalent technical function.

What is claimed is:

1. A high or medium voltage gas insulated earthing switch comprising at least one conducting bar in a hermetically sealed enclosure that will be filled with a dielectrically insulating gas, with a corresponding earthing contact, a phase contact fixed to the said bar that will be electrically connected to the earthing contact to earth the said bar, characterised in that the earthing contact is installed fixed in the enclosure facing the phase contact, leaving a free space between this phase contact and the earthing contact, and in that a switching element is installed free to move in the enclosure between the phase contact and the earthing contact in a plane transverse to the conducting bar, this switching element comprising firstly a switching contact that short circuits the space left free between the phase contact and the earthing contact to electrically connect the earthing contact and the phase contact when the earthing switch is closed, and secondly an at least partly electrically insulating support on which the switching contact is fixed such that the switching contact is electrically isolated from the phase contact and from the earthing contact when the earthing switch is in an open position.

2. The earthing switch according to claim 1, in which the earthing contact and the phase contact are aligned with the axis of the conducting bar.

3. The earthing switch according to claim 2, in which the earthing contact and the phase contact are arranged along the axial extension of each conducting bar.

4. The earthing switch according to claim 2, in which the switching contact is free to move transverse to the conducting bar.

5. The earthing switch according to claim 1, comprising three parallel conducting bars arranged in an equilateral triangle configuration and in which the switching element is installed rotating around a rotation axis (R) arranged at the centre of the triangle.

6. The earthing switch according to claim 5, in which the switching element comprises three switching contacts installed according to a delta configuration on a rotating support.

7. The earthing switch according to claim 6, in which the rotating support is a star-shaped support with three arms, each made of an electrically insulating material.

8. The earthing switch according to claims 1, in which the switching element is installed rotating on a cover closing the enclosure.

9. The earthing switch according to claim 1, comprising three parallel conducting bars arranged in a row and in which the switching element is installed free to slide in the enclosure transverse to the conducting bars.

10. The earthing switch according to claim 9, in which the switching element comprises three switching contacts arranged in a row on a sliding support.

11. The earthing switch according to claim 10, in which the sliding support is a bar made of an insulating material.

12. The earthing switch according to claim 1, in which the switching contact comprises elastically deformable contact pins.

13. The earthing switch according to claim 12, which each switching contact is U-shaped with the elastic contact pins arranged at each end of an arm of the U, such that the current circulating in one arm is opposite to the current circulating in the other arm, when the said switching element connects an earthing contact to a phase contact.

14. The earthing switch according to claim 12, in which each switching contact is in the form of a closed curve with elastic contact elements arranged at two locations on this closed curve, such that the current circulating from one side of the contact to the other is shared between the two halves of this closed curve when the said switching contact connects an earthing contact to a phase contact.

15. The earthing switch according to claim 12, in which each switching contact is fitted with two switching rods fixed to a conducting support of the switching element, and each being intended to be inserted in a female tulip-shaped contact of one of the two contacts.

16. The earthing switch according to claim 15, in which the switching rod corresponding to the earthing switch is longer than the other rod.

17. The earthing switch according to claim 1, in which each earthing contact is fixed to the enclosure using an insulating tube so as to electrically isolate this earthing switch from the enclosure.

18. The earthing switch according to claim 1, in which an elastic contact is fixed to the enclosure, in order to electrically connect a switching contact to the enclosure when the earthing switch is in a fully open position to avoid this switching contact being at a floating potential.

* * * * *